US007960631B1

(12) United States Patent
Chang

(10) Patent No.: US 7,960,631 B1
(45) Date of Patent: Jun. 14, 2011

(54) CLARINET COUPLING STRUCTURE

(75) Inventor: I-Ping Chang, Taichung (TW)

(73) Assignee: King Dee Musical Instrument Corp., Taichung (TW)

( * ) Notice: Subject to any disclaimer, the term of this patent is extended or adjusted under 35 U.S.C. 154(b) by 0 days.

(21) Appl. No.: 12/748,820

(22) Filed: Mar. 29, 2010

(51) Int. Cl.
*G10D 7/06* (2006.01)

(52) U.S. Cl. ..... 84/382

(58) Field of Classification Search ..... 84/380 R, 84/382, 383 R, 383 A, 385 A
See application file for complete search history.

(56) References Cited

U.S. PATENT DOCUMENTS 4,723,470 A * 2/1988 Yamaryo ..... 84/380 R
* cited by examiner

*Primary Examiner* — Kimberly R Lockett
(74) *Attorney, Agent, or Firm* — Muncy, Geissler, Olds & Lowe, PLLC

(57) ABSTRACT

A clarinet coupling structure comprises at least one first hollow tube and at least one second hollow tube that are fastenable by swiveling. The first hollow tube includes a first coupling portion and a plurality of first bumps located on the surface of the first coupling portion. The first bumps are spaced by a plurality of first gaps formed between them. The second hollow tube includes a second coupling portion and a plurality of second bumps located on the surface of the second coupling portion. The second bumps are spaced by a plurality of second gaps formed between them to receive the first bumps. The second gaps also have a plurality of lateral movement sections to allow the first bumps to slide in and latch inside. Through such a structure, various elements of wind instruments can be assembled and disassembled quickly and damage can also be prevented.

5 Claims, 7 Drawing Sheets

CLARINET COUPLING STRUCTURE

FIELD OF THE INVENTION

The present invention relates to a coupling structure and particularly to a clarinet coupling structure.

BACKGROUND OF THE INVENTION

Please refer to FIG. 1, a conventional clarinet 1 is lengthy and difficult to carry, and also has a slim and delicate structure, and could be out of tone upon impact, hence usually is held in a protective case for carrying to avoid impact or damage. As the case for the clarinet 1 has to match the profile thereof that results in a bulky size and not easy to carry, the wind instruments usually are disassembled in sections to be held in a case to facilitate carrying and transportation, and are assembled when in use.

The clarinet 1 has blowing orifices 2 covered by depressible finger plates that are blown by air to generate different tones. If the coupling structure of the clarinet 1 is not tightly formed, air could leak out through gaps of a coupling joint 3 in addition to delivering through the blowing orifices 2, and result in out of tone during playing. To prevent such a problem from taking place, a cork 4 is commonly disposed at the coupling joint 3 in the conventional design to avert air leakage through gaps formed at the coupling joint. The conventional clarinet 1 generally is formed at a diameter based on the temperature of frigid zone countries to smooth tight coupling of the coupling joint without forming gaps or causing tone errors. However, in countries located in the tropical zone where the temperature is higher, heat expansion increases the size of the cork 4 that makes assembly and disassembly of the clarinet 1 difficult and requiring a greater effort. It is troublesome for users without powerful physical strength. Moreover, trying to assemble and disassemble the clarinet 1 forcefully tends to damage the structure and elements of the clarinet 1.

SUMMARY OF THE INVENTION

Therefore, the primary object of the present invention is to solve the problem that the conventional clarinet is difficult to assemble and disassemble.

Another object of the invention is to overcome the problem of forming gaps at the coupling joints caused by cold shrinking in the conventional techniques.

To achieve the foregoing objects, the present invention provides a clarinet coupling structure that includes at least one first hollow tube and at least one second hollow tube fastened to the first hollow tube by swiveling. The first hollow tube has a first coupling portion and a plurality of first bumps located on the surface of the first coupling portion. The first bumps are spaced by a plurality of first gaps. The second hollow tube includes a second coupling portion mating and coupling with the first coupling portion, and a plurality of second bumps located on the surface of the second coupling portion. The second bumps are spaced by a plurality of second gaps to receive the first bumps. The second gaps further have a plurality of lateral movement sections to allow the first bumps to slide and latch therein by swiveling.

By means of the foregoing structure, the second gaps formed by the second bumps can receive the first bumps, and the lateral movement sections can be latched by the first bumps by swiveling. Thereby the first and second hollow tubes can be fastened or separated quickly by swiveling to facilitate assembly and disassembly of the clarinet.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
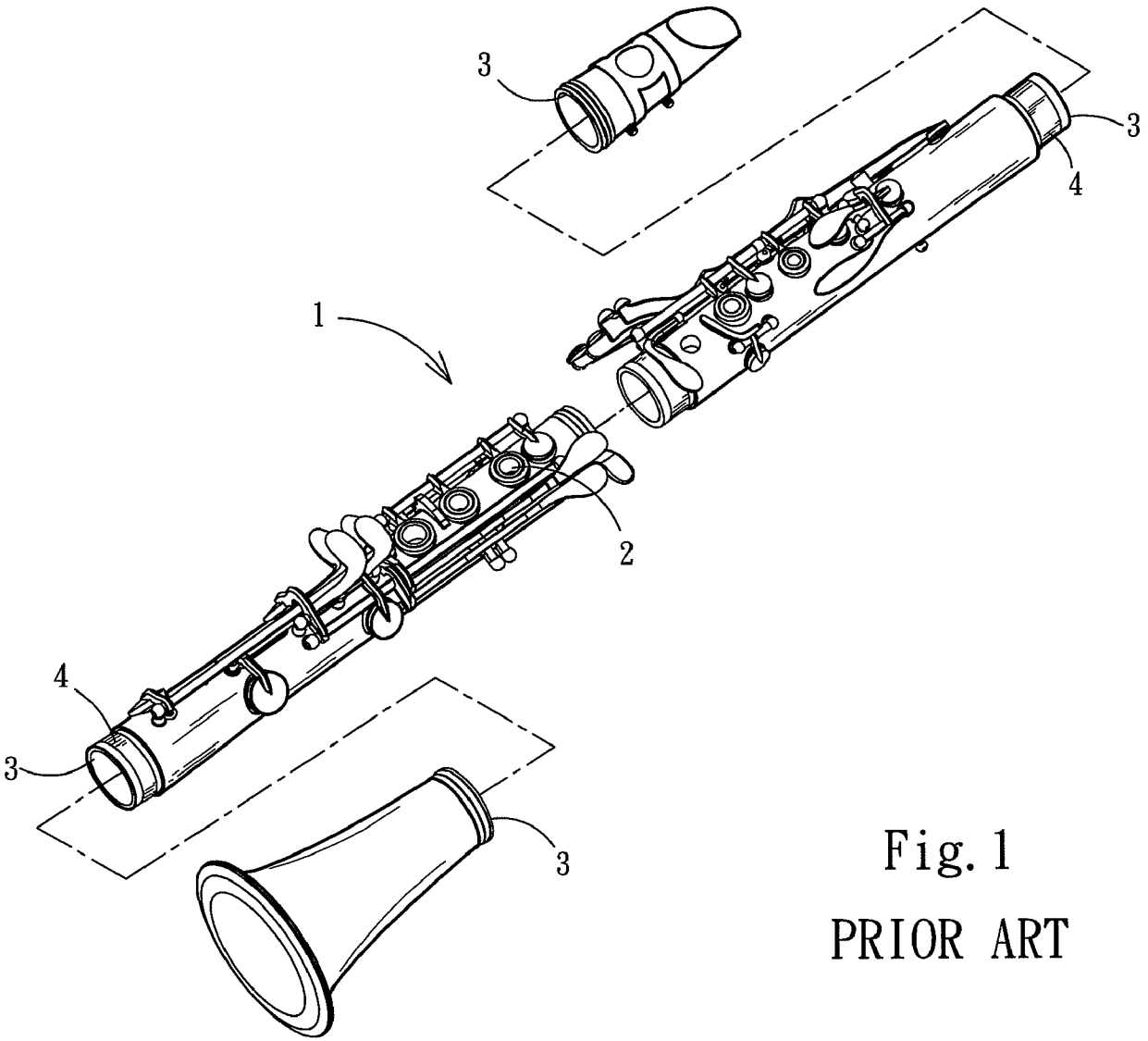
Fig. 1 PRIOR ART
FIG. 1 is a perspective view of a conventional clarinet.
Figure 2:
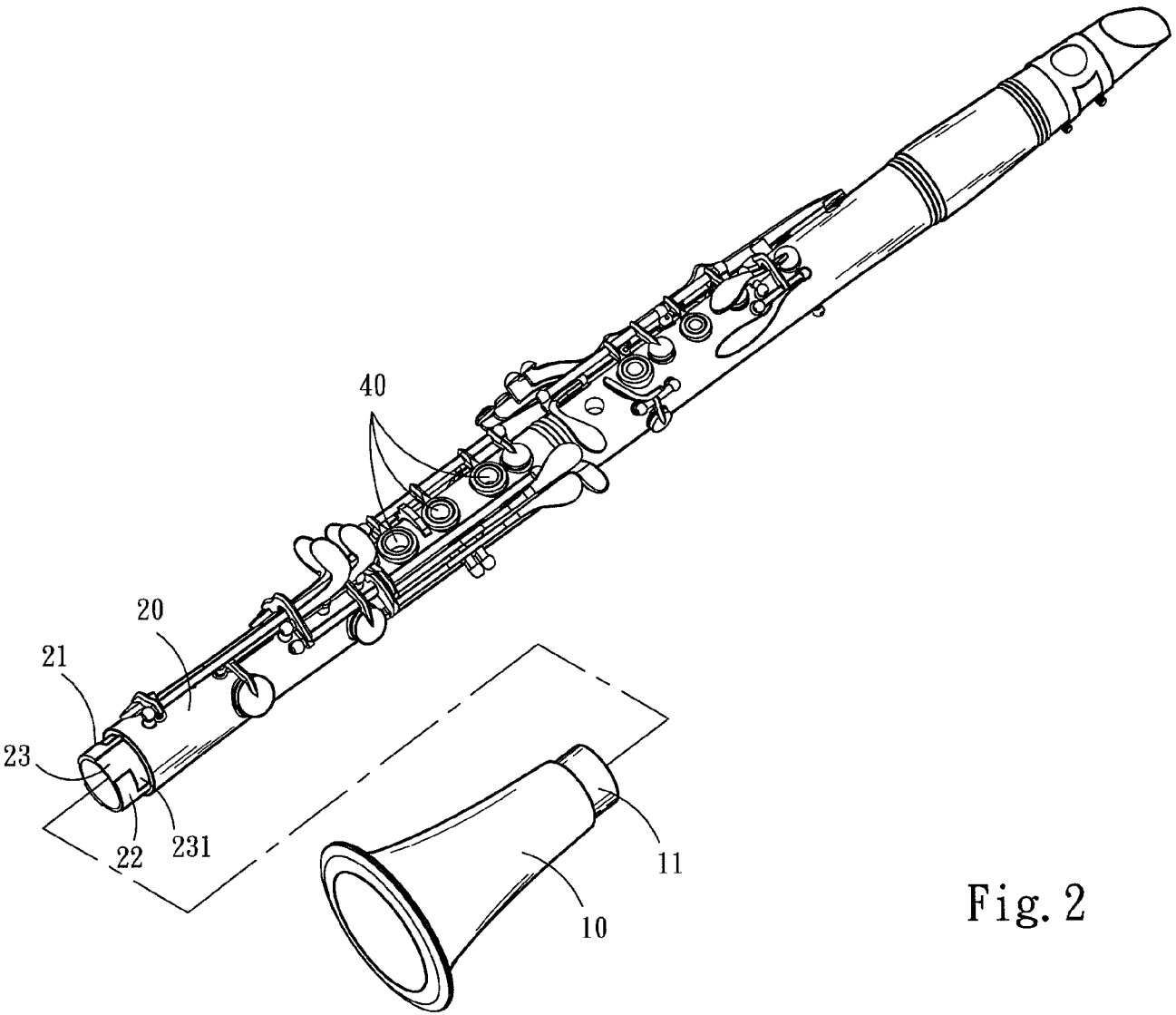
FIG. 2 is a perspective view of an embodiment of the invention.
Figure 3A:
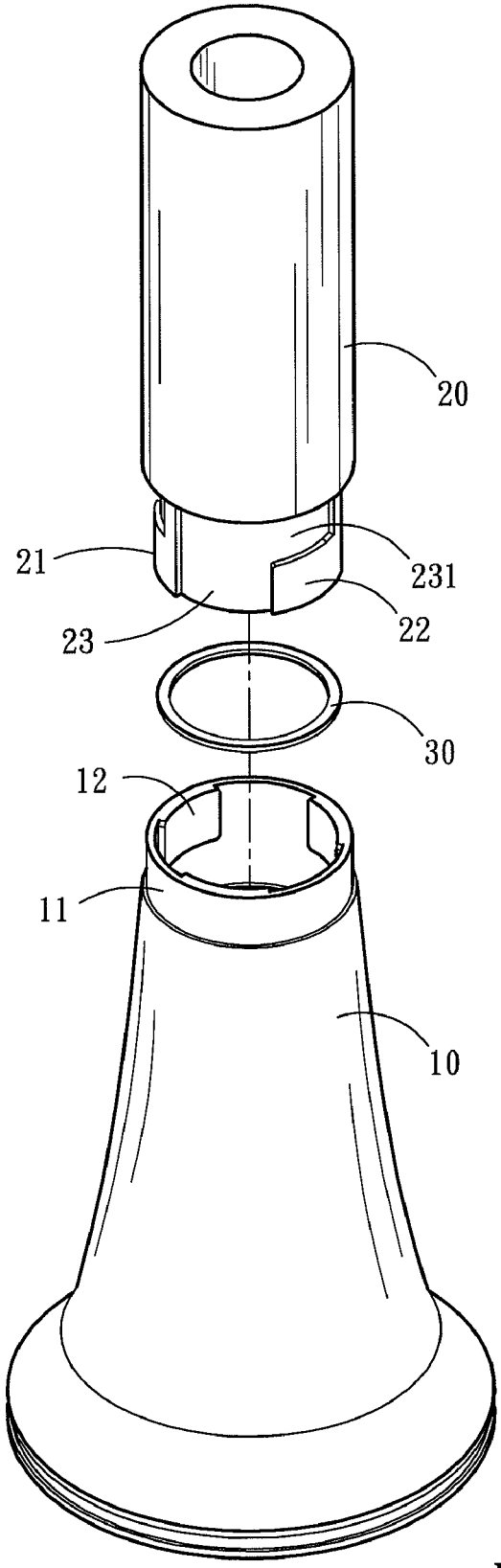
FIG. 3A is a schematic view of an embodiment of the invention in a disassembling condition.
Figure 3B:
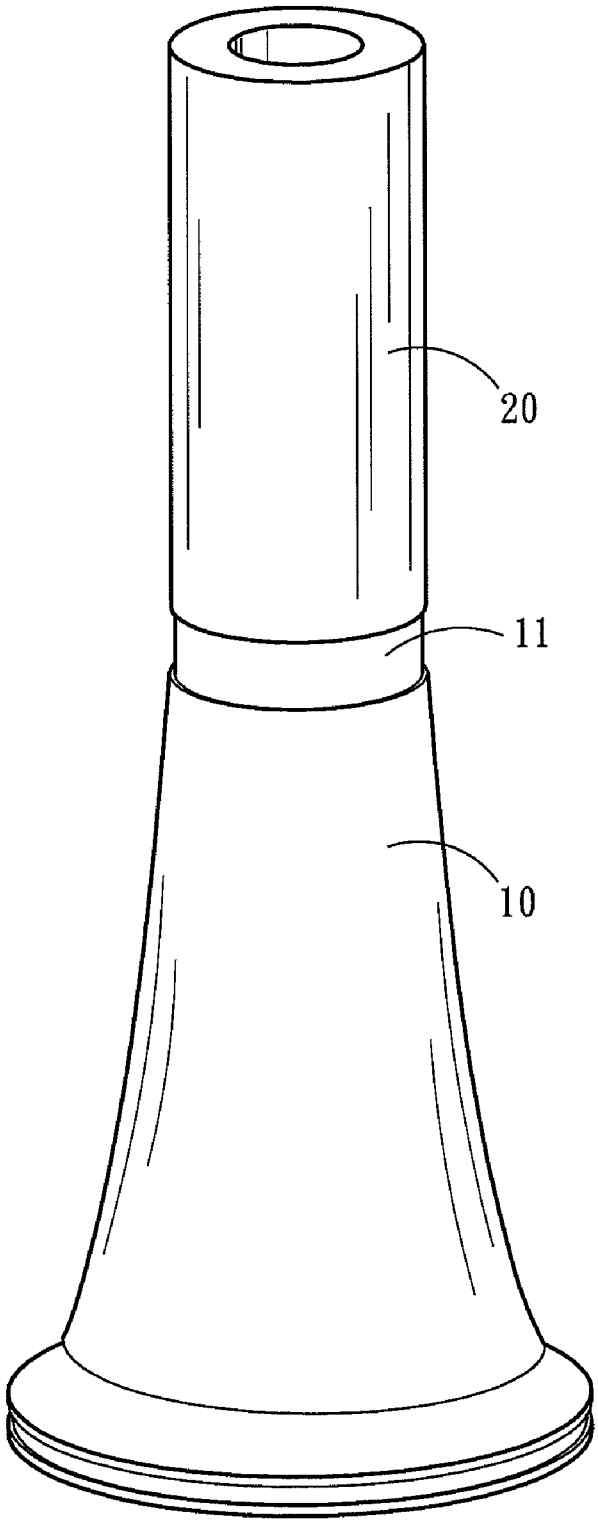
FIG. 3B is a schematic view of an embodiment of the invention in an assembling condition.

Please refer to FIGS. 2, 3A and 3B for an embodiment of the invention that is a coupling portion close to one end of a clarinet. Eventually such a structure can be adopted to any coupling portion of the clarinet. The clarinet coupling structure according to the invention includes at least one first hollow tube 10 and at least one second hollow tube 20 fastened to the first hollow tube 10 by swiveling. The first hollow tube 10 has a first coupling portion 11 and a plurality of first bumps 12 located on the surface of the first coupling portion 11. The first bumps 12 are spaced by a plurality of first gaps 13 between them. The second hollow tube 20 has a second coupling portion 21 mating and fastenable to the first coupling portion 11, and a plurality of second bumps 22 located on the surface of the second coupling portion 21. The second bumps 22 are spaced by a plurality of second gaps 23 between them to receive the first bumps 12. The second gaps 23 also have a plurality of lateral movement sections 231 to be slid and latched by the first bumps 12 by swiveling. In this embodiment, the second hollow tube 20 also has a plurality of blowing orifices 40 depressible by users to generate sound of different tones.

The first coupling portion 11 is formed at an inner diameter greater than the outer diameter of the second coupling portion 21. The first bumps 12 are located on an inner surface of the first coupling portion 11, while the second bumps 22 are located on an outer surface of the second coupling portion 21. The first bumps 12 and second bumps 22 can be wedged respectively in the second gaps 23 and first gaps 13. Then the first bumps 12 can be slid and latched in the lateral movement section 231 by swiveling to form secure fastening between the first coupling portion 11 and second coupling portion 21.

The first bumps 12 are formed at varying lengths to form the first gaps 13 of different lengths. The second bumps 22 mate the first bumps 12 and also are formed at varying lengths with the second gaps 23 at different lengths. Hence the first hollow tube 10 and second hollow tube 20 can be fastened and latched only at a single angle to avoid erroneous coupling of the first coupling portion 11 and second coupling portion 21. The coupling structure of the invention also provides a sealing ring 30 located between the first and second coupling portions 11 and 21 to prevent air leakage through gaps formed between the first and second coupling portions 11 and 21, thereby to avert out of tone problem that might otherwise occur.

Figure 4A:
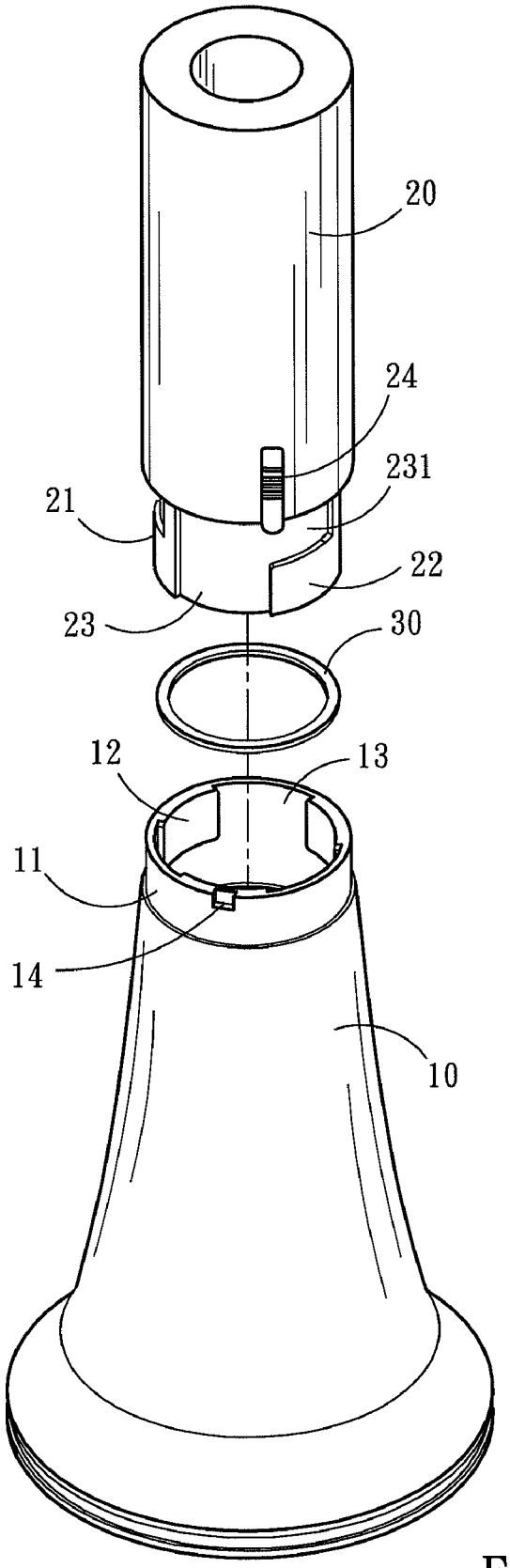
FIG. 4A is a schematic view of another embodiment of the invention in a disassembling condition.
Figure 4B:
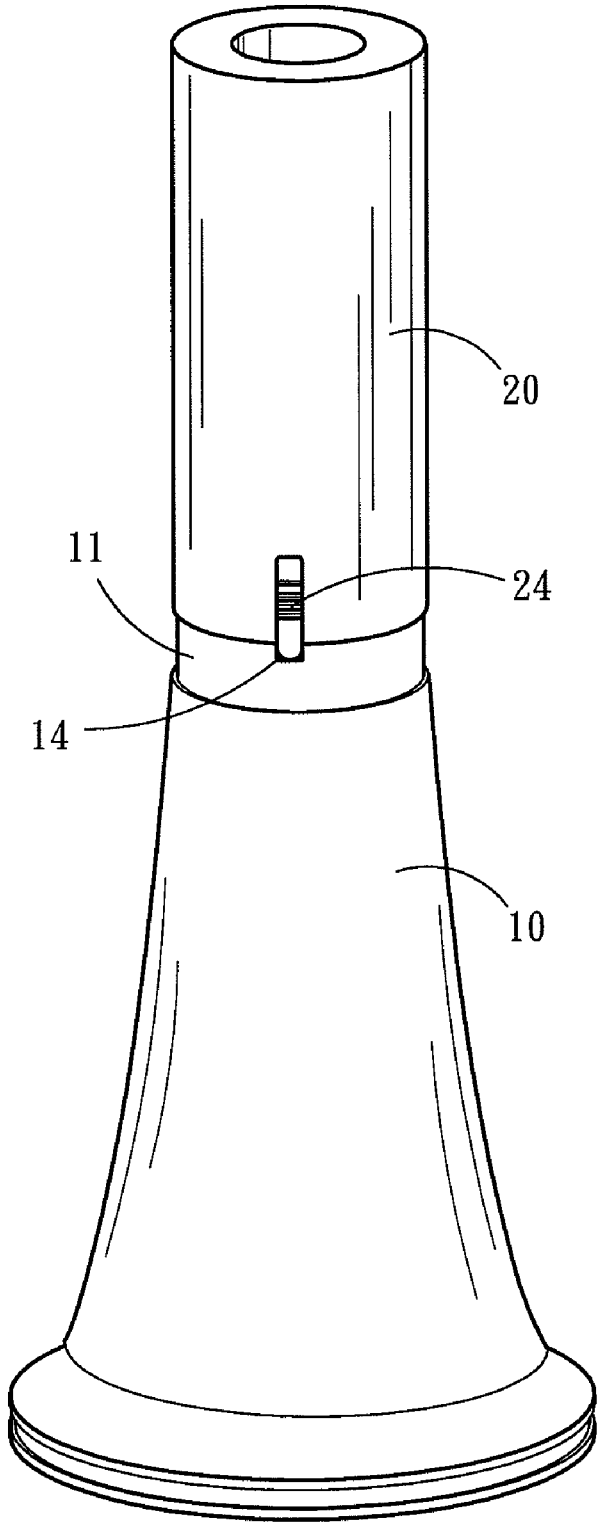
FIG. 4B is a schematic view of another embodiment of the invention in an assembling condition.
Figure 5:
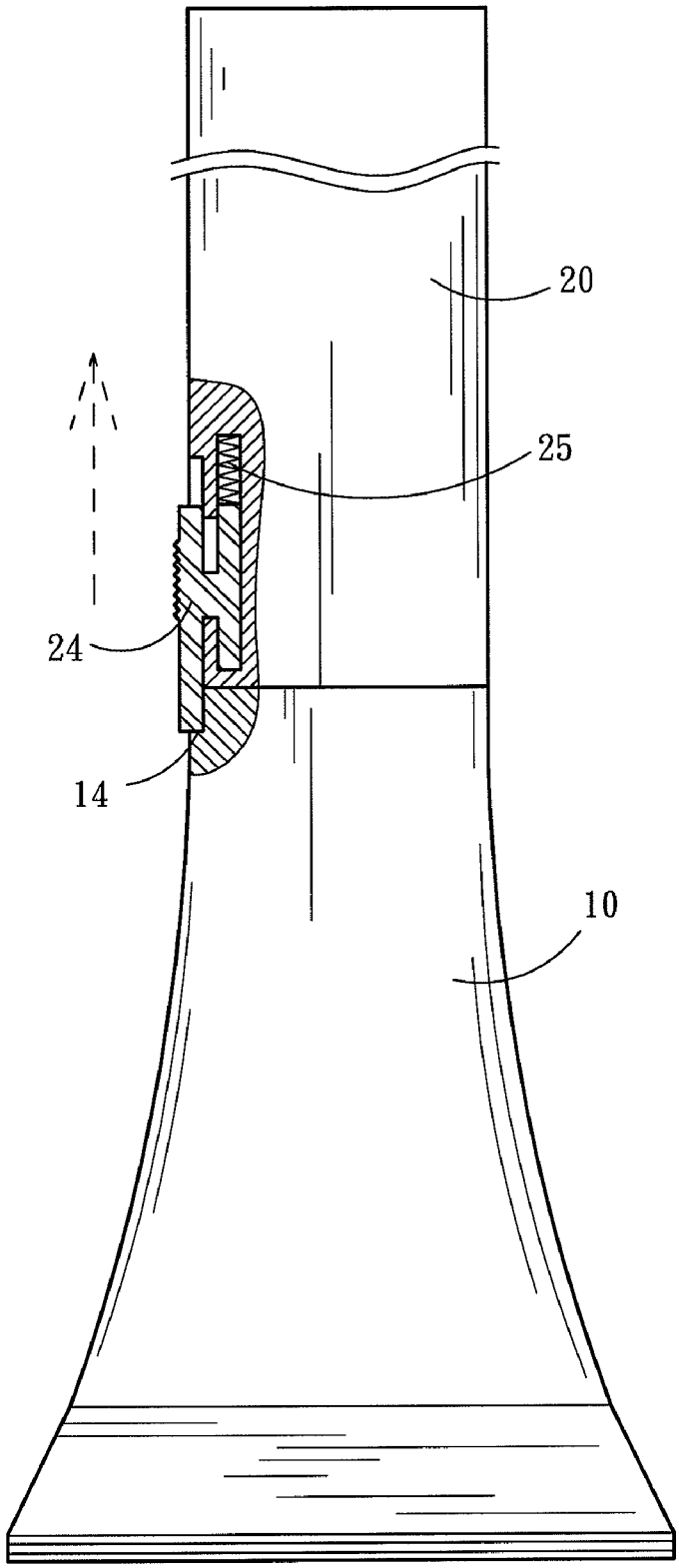
FIG. 5 is a partly sectional view of another embodiment of the invention.

Refer to FIGS. 4A, 4B and 5 for another embodiment of the invention. The first hollow tube 10 further has a first latch portion 14 to prevent loosening and separation of the first and second hollow tubes 10 and 20. The second hollow tube 20 has a second latch portion 24 mating the first latch portion 14. In this embodiment, the first latch portion 14 is a trough, and the second latch portion 24 has a latch element mating the trough and an elastic element 25 coupling with the latch element. When the first coupling portion 11 is fastened to the second coupling portion 21 by swiveling, the latch element compresses towards the first coupling portion 11 through the elastic element 25 to slide into the first latch portion 14, hence the first coupling portion 11 and second coupling portion 21 are prevented from loosening off by swiveling in the opposite direction after coupling. When disassembly of the first coupling portion 11 and second coupling portion 21 is desired, first, push the latch element against the elastic element 25 to escape the trough; next, turn the first coupling portion 11 and second coupling portion 21 in a direction reverse to the sliding direction of the first bumps 12 in the lateral movement section 231, then first hollow tube 10 and second hollow tube 20 can be disengaged and separated.

As a conclusion, the invention, the first bumps 12 wedge in the second gaps 23 formed by the second bumps 22 and slide and latch in the lateral movement section 231 by swiveling to facilitate fastening and unfastening of the first hollow tube 10 and second hollow tube 20. Therefore, fast assembly and disassembly of the clarinet can be accomplished. In addition, with the sealing ring 30 is interposed between the first and second coupling portions 11 and 21, air leakage can be prevented to avoid out of tone problem. By latching and fastening the first latch portion 14 and second latch portion 24, loosening off caused by swiveling of the first and second coupling portions 11 and 21 also can be averted.

In summation of the above description, the present invention provides a significant improvement over the conventional techniques and complies with the patent application requirements, and is submitted for review and granting of the commensurate patent rights.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A clarinet coupling structure, comprising:

at least one first hollow tube which includes a first coupling portion and a plurality of first bumps located on the surface of the first coupling portion that are spaced by a plurality of first gaps formed between them; and at least one second hollow tube which is fastenable to the first hollow tube by swiveling and includes a second coupling portion mating and fastenable to the first coupling portion and a plurality of second bumps located on the surface of the second coupling portion to mate the first bumps; the second bumps being spaced by a plurality of second gaps formed between them to receive the first bumps, the second gaps including a plurality of lateral movement sections to allow the first bumps to slide in and latch inside by swiveling.

2. The clarinet coupling structure of claim 1, wherein the first coupling portion is formed at an inner diameter greater than an outer diameter of the second coupling portion, the first bumps being located on an inner surface of the first coupling portion, the second bumps being located on an outer surface of the second coupling portion.

3. The clarinet coupling structure of claim 1, wherein the first bumps are formed at varying lengths to form the first gaps of different lengths, the second bumps being formed at varying lengths to mate the first bumps and form the second gaps of different lengths.

4. The clarinet coupling structure of claim 1, wherein the first coupling portion and the second coupling portion are interposed by a sealing ring to prevent gaps formed therebetween.

5. The clarinet coupling structure of claim 1, wherein the first hollow tube includes a first latch portion to prevent the first coupling portion and the second coupling portion from loosening off, the second hollow tube including a second latch portion to mate the first latch portion.

* * * * *